US008237736B2

(12) United States Patent
Flick

(10) Patent No.: US 8,237,736 B2
(45) Date of Patent: Aug. 7, 2012

(54) USER INTERFACE COLOR BASED ON BACKGROUND IMAGE

(75) Inventor: Mark S Flick, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 1284 days.

(21) Appl. No.: 11/421,626

(22) Filed: Jun. 1, 2006

(65) Prior Publication Data

US 2007/0279430 A1 Dec. 6, 2007

(51) Int. Cl.
*G09G 5/02* (2006.01)

(52) U.S. Cl. ..... 345/593

(58) Field of Classification Search ..... 345/594, 345/593

See application file for complete search history.

(56) References Cited

U.S. PATENT DOCUMENTS

| | | | | |
|---|---|---|---|---|
| 5,047,842 | A * | 9/1991 | Bouman et al. | 358/515 |
| 5,434,957 | A * | 7/1995 | Moller | 345/593 |
| 5,509,111 | A * | 4/1996 | Hong et al. | 345/591 |
| 5,703,627 | A | 12/1997 | Young | |
| 5,877,772 | A | 3/1999 | Nomura et al. | |
| 6,023,274 | A | 2/2000 | Griffiths | |
| 6,292,187 | B1 | 9/2001 | Gibbs et al. | |
| 6,344,861 | B1 | 2/2002 | Naughton et al. | |
| 6,518,981 | B2 * | 2/2003 | Zhao et al. | 715/764 |
| 6,731,310 | B2 | 5/2004 | Craycroft et al. | |
| 7,064,759 | B1 * | 6/2006 | Feierbach et al. | 345/469.1 |
| 2001/0012399 | A1 * | 8/2001 | Tohyama et al. | 382/167 |
| 2005/0039142 | A1 | 2/2005 | Jalon et al. | |
| 2005/0100211 | A1 | 5/2005 | Gibson et al. | |
| 2006/0066628 | A1 | 3/2006 | Brodie et al. | |

OTHER PUBLICATIONS

Imbrogno et al., "Geografitals: Animation Friendly Cartoon Procedural Textures" Available at http://www.cs.mcgill.ca/~mimbro/cs767/paper.pdf, 10 pages.

Myers, "User Interface Software Tools" Available at http://delivery.acm.org/10.1145/210000/200971/p64-myers.pdf?key1=200971&key2=1304144411&coll=GUIDE&dl=GUIDE&CFID=73138734& CFTOKEN=12798511, ACM Transactions on Computer-Human Interaction, vol. 2, No. 1, Mar. 1995, pp. 64-103.

* cited by examiner

*Primary Examiner* — Edward Martello
(74) *Attorney, Agent, or Firm* — Lee & Hayes, PLLC

(57) ABSTRACT

Various embodiments utilize a set of pixels that that make up an image that is to appear in a user interface. The method divides the applicable color space into pre-defined regions and then analyzes the image by mapping color values associated with pixels of the image into defined regions. After mapping the color values, the method determines which one or more region(s) is associated with the most mapped color values and then selects that region(s) for further analysis. Using the selected region(s), the method then divides the region(s) into further sub-regions and repeats the mapping process, progressively narrowing the regions down until a single color is selected for use in a frame that comprises part of the user interface.

17 Claims, 5 Drawing Sheets

USER INTERFACE COLOR BASED ON BACKGROUND IMAGE

BACKGROUND

Finding a user interface color that is suitable with respect to an image that appears in a user interface can be a difficult endeavor. For example, a user may have a background image as part of their user interface and may wish for other visible portions in the interface to be of a suitable, perhaps closely matching color with respect to the image. Typically, in order to find such a color, the user must manually sample available colors, hoping to find one that is suitable. Unfortunately, given the large number of potential color choices, and the diversity of colors and color shades often found in even smaller images, this method places a heavy burden on the user and may likely not produce the best results. For example, RGB, a common color definition scheme, provides for up to 16,777,216 (24-bit) possible discrete colors or color shades, This makes the task of finding the right color akin to searching for a needle in a haystack. Attempts to make this task easier by reducing the available colors have been unsatisfactory because they still leave the user with an unwieldy number of colors to manually choose from. For example, a palletized color scheme contains up to 256 possible colors. Similarly, methods for blending or otherwise combining various colors from an image are also unsatisfactory because the result is often a color shade that is unsuitable and not prominently found in the image itself.

SUMMARY

The methods described below utilize a set of pixels that that make up an image that is to appear in a user interface. The method divides the applicable color space into pre-defined regions and then analyzes the image by mapping color values associated with pixels of the image into defined regions. After mapping the color values, the method determines which one or more region(s) is associated with the most mapped color values and then selects that region(s) for further analysis. Using the selected region(s), the method then divides the region(s) into further sub-regions and repeats the mapping process, progressively narrowing the regions down until a single color is selected for use in a frame that comprises part of the user interface.

DETAILED DESCRIPTION

Overview

The method described below utilizes a set of pixels that that make up an image that is to appear in a user interface. The method divides the applicable color space into pre-defined regions and then analyzes the image by mapping color values associated with pixels of the image into defined regions. After mapping the color values, the method determines which one or more region(s) is associated with the most mapped color values and then selects that region(s) for further analysis. Using the selected region(s), the method then divides the region(s) into further sub-regions and repeats the mapping process, progressively narrowing the regions down until a single color is selected for use in a frame that comprises part of the user interface.

Exemplary Embodiment

Figure 1:
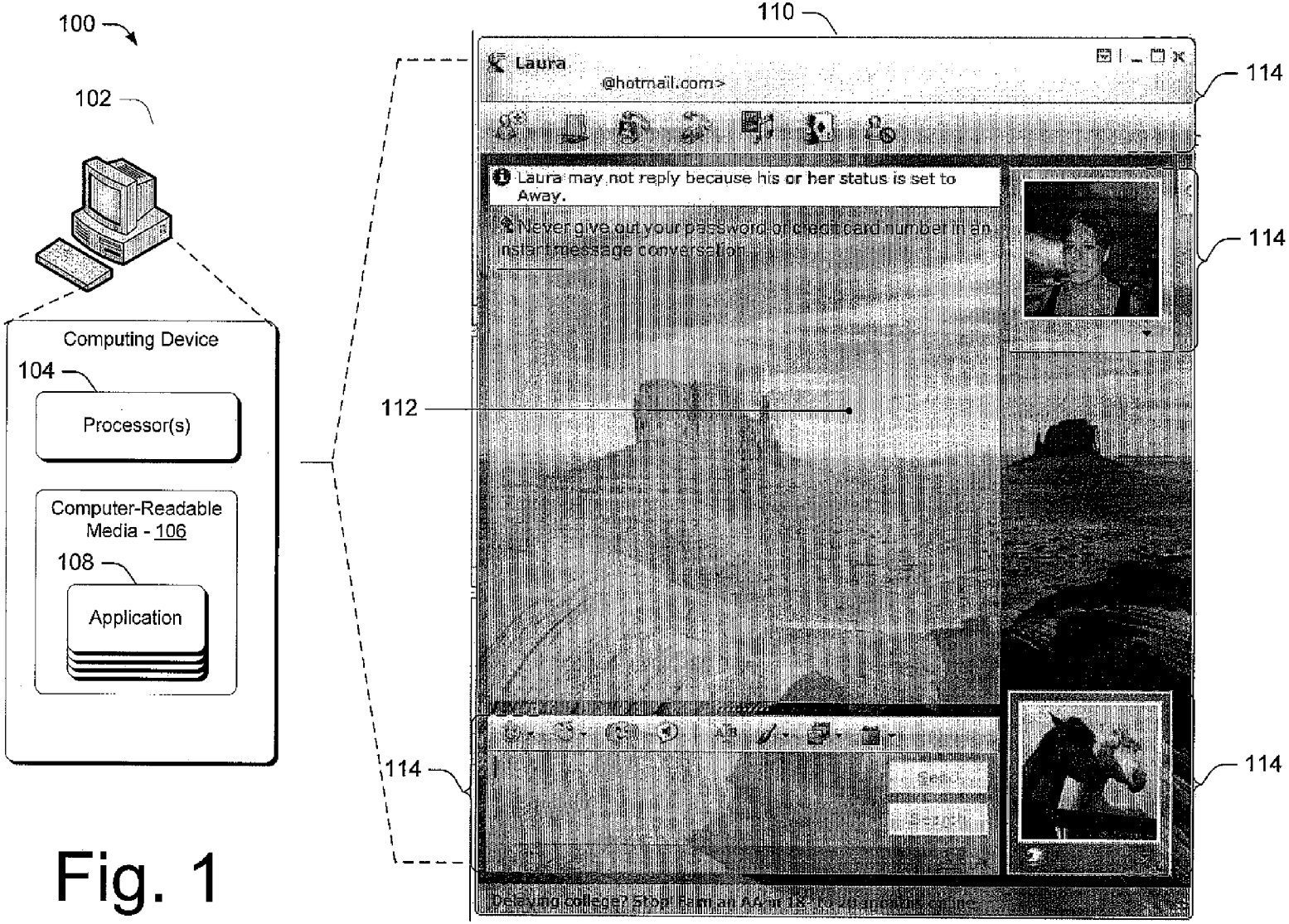
FIG. 1 is a high level diagram of an exemplary system in accordance with one embodiment.

FIG. 1 illustrates an exemplary system, generally at 100, in which the principles and methods described below can be implemented in accordance with one embodiment. These principles and methods can be used to select one or more colors for use in a frame that comprises part of a user interface.

System 100 includes, in this example, one or more computing devices 102 each of which includes one or more processors 104, one or more computer-readable media 106 and one or more applications 108 that reside on the computer-readable media and which are executable by the processor(s).

Although computing device 102 is illustrated in the form of a desktop computer, it is to be appreciated and understood that other computing devices can be utilized without departing from the spirit and scope of the claimed subject matter. Other computing devices can include, by way of example and not limitation, portable computers, handheld computers such as personal digital assistants (PDAs), cell phones and the like. For example, a user of a cell phone may decide to include a family picture in their cell phone's user interface. Utilizing the principles described below, a suitable and pleasing color for the visible surrounding frames in the phone's interface can be automatically set, without requiring the user to manually sample and test a myriad of potential colors.

Also illustrated as part of system 100 is an exemplary user interface 110 that might be presented to a user of a computing device. Specifically, user interface 110 is illustrated as including a background image 112 and several visible interface frames 114 adjacent to the image. While this example illustrates a particular user interface, i.e. a user interface for Microsoft's instant messaging application Live Messenger, it should be noted that the principles described in this document can be utilized in connection with any user interface in any application.

In this particular example, although the actual figures in the document appear in black and white, the background image 112 includes various colors that make up two desert bluffs and a cloud-streaked sky. The user interface frames 114, which are visible and adjacent the background image, have a suitable color that matches the blue sky, thus presenting the user with an aesthetically pleasing and complimentary interface. This has been accomplished automatically, using the principles described below.

To provide some tangible context for the reader to appreciate how the principles and methods described below can be applied, consider FIGS. 2A and 2B which conceptually illustrate a first embodiment in which an aesthetically pleasing and complimentary interface color can be automatically and dynamically identified.

Figure 2A:
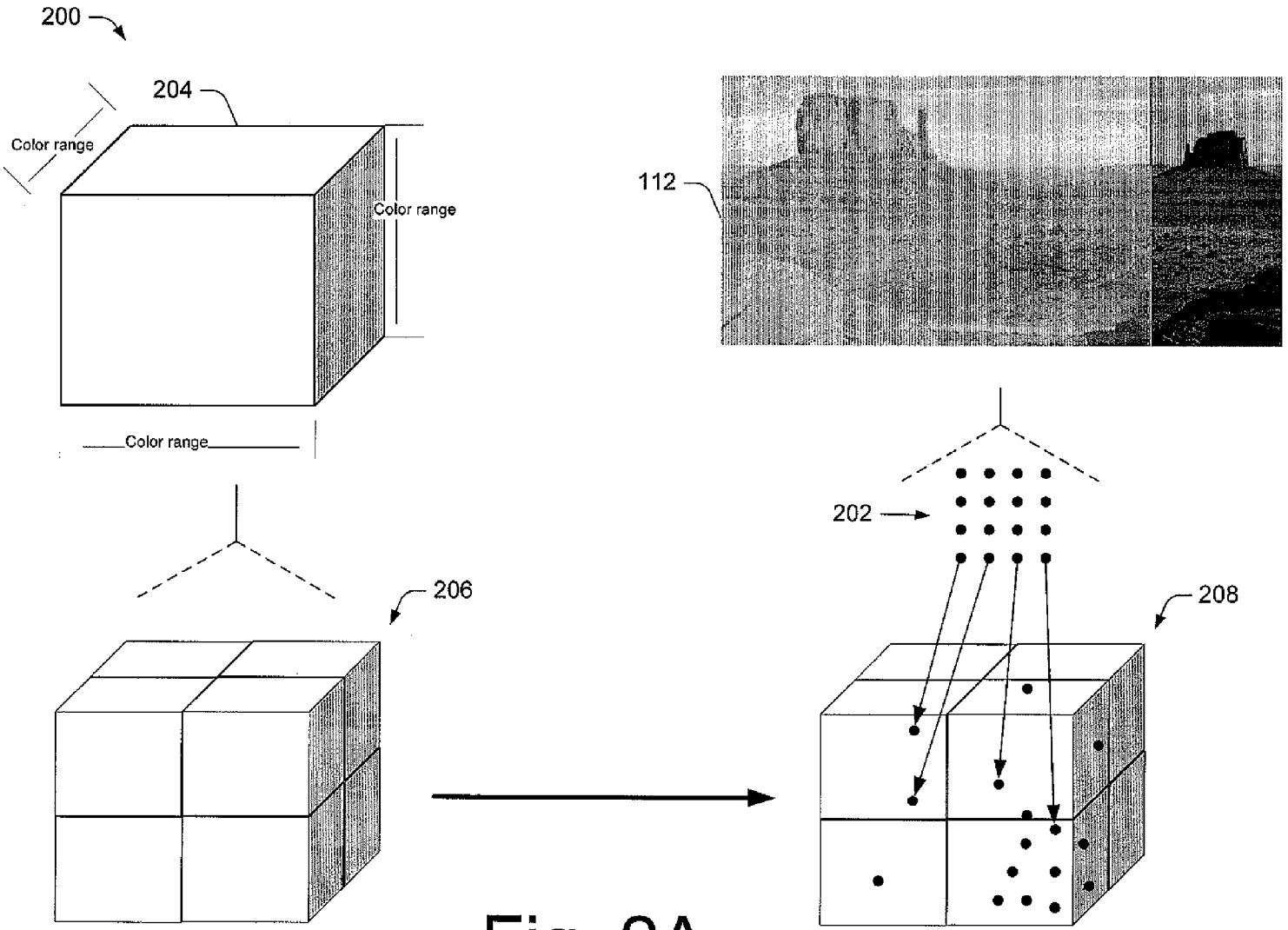
FIG. 2A illustrates a conceptual example of mapping color values associated with pixels in an image to a color space, in accordance with one embodiment.

FIG. 2A illustrates, generally at 200, an embodiment where color values associated with pixels in an image can be mapped. First, recall that user interface 110, illustrated in FIG. 1, includes a background image and visible frames 114 that are adjacent the background image. Here, background image 112 is shown without these adjacent user interface frames. Background image 112, like any image, comprises a number of individual pixels, some or all of which can be included in a pixel sample 202 taken from the image. Each of the pixels in pixel sample 202, like all pixels, is associated with a corresponding color value which can be mapped to a point or region within an abstract geographical structure called a "color space". In at least some embodiments, these color values can represent intensities of the colors red, green and blue ("RGB" values). However, any other suitable type of color value can be used without departing from the spirit and scope of the claimed subject matter. Examples of other types include: palletized color (256-color), CMYK, Hi-color, or RGBA numerical values, to name just a few.

A color space can be conceptualized as a bounding geographical structure with its parameters or dimensions defined by a range of color values. In at least some embodiments, a color space can be conceptualized in three-dimensions, with each dimension defined by a range of color values for a particular color. One such exemplary color space is indicated at 204. Note that color space 204 can be subdivided into different regions as indicated generally at 206. Each region is defined by a smaller range of color values than that used to define the entire color space 204. Here, color space 206 represents color space 204 after being subdivided into eight smaller cubic regions. Since the different subdivided regions are associated with different ranges of color values, each is also associated with different shades of colors. At the most granular level, the smallest regions are associated with a single color value. For example, if RGB values are used as the color-range parameters to define color space 204, the smallest regions will correlate with an RGB color value for a single color.

It is to be appreciated and understood that while a three-dimensional color space is illustrated here, this constitutes but one example and is not to be used to limit application of the claimed subject matter to this particular context. Rather, the principles described can be employed in other contexts as well. For example, a color space with a different number of dimensions, such as two, four or more dimensions, may be utilized without departing from the spirit and scope of the claimed subject matter. Furthermore, any suitable type of color space value can be used. Examples include, without limitation: RGB, palletized color (256-color), CMYK, Hi-color, or RGBA values.

Continuing, recall that that each pixel in the group of sample pixels 202 has a corresponding color value which provides a means for mapping to a color space. When the color space is subdivided into a number of regions, here represented by color space 206, each sample pixel's color value can be mapped to one of the number of regions by using the pixel's corresponding color value. Any suitable means for mapping can be utilized without departing from the spirit and scope of the claimed subject matter. By way of example and not limitation, in at least one embodiment a path or channel to each of the regions is defined. Each sample pixel's color value is then associated with one of the paths or channels such that each color value is effectively mapped to a particular region. Here, color space 208 represents color space 206 after each of the pixel color values from sampled pixels 202 has been mapped to it. Note that in this example, some of the regions are associated with a larger quantity of mapped color values than other regions. In fact, some regions are not associated with any mapped color values at all. Determining which region or regions are associated with the most mapped pixel color values can be useful, as described below.

Figure 2B:
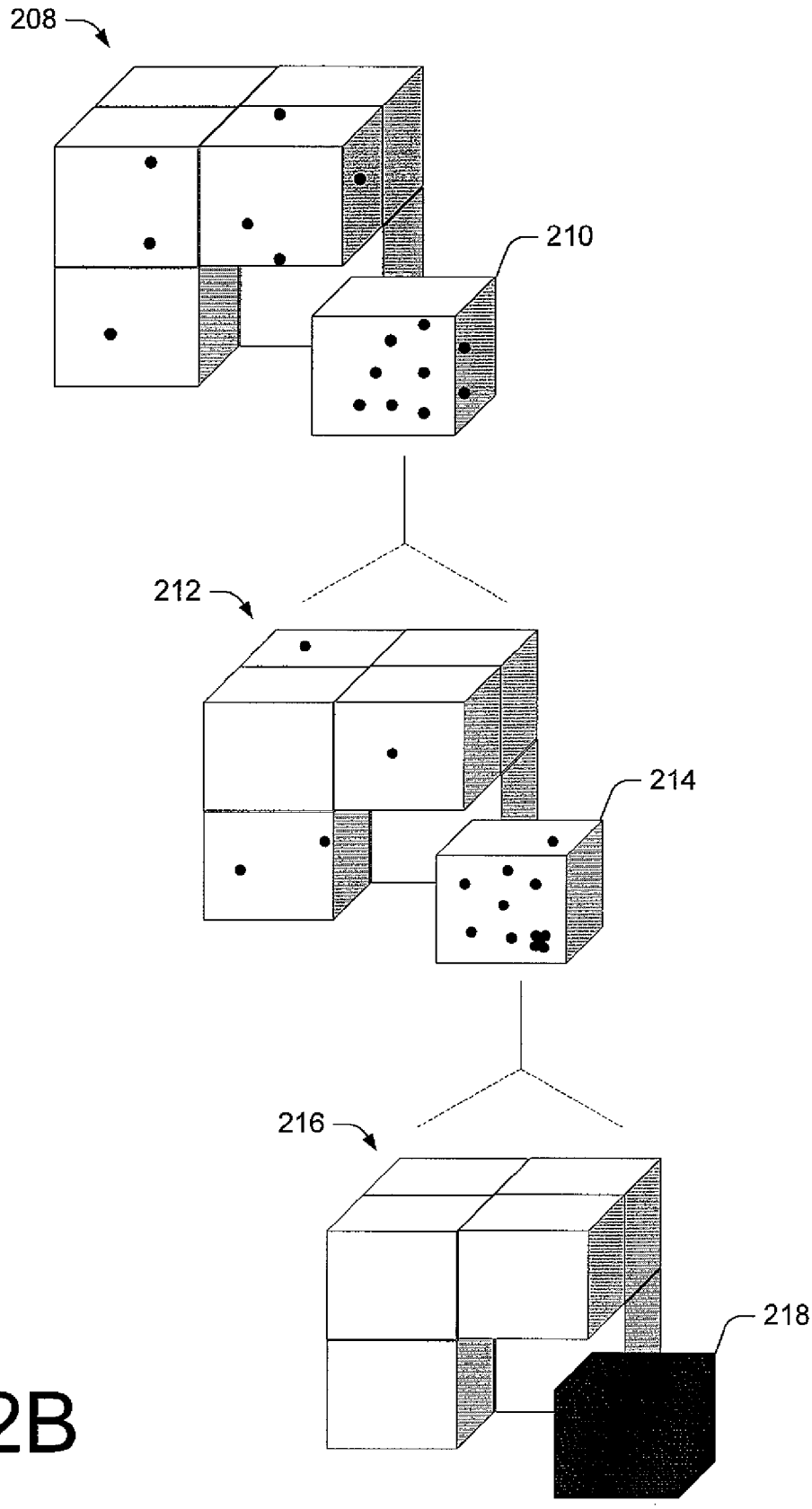
FIG. 2B illustrates a conceptual example of identifying current regions of interest in color spaces, in accordance with one embodiment.

Consider now FIG. 2B which illustrates the embodiment depicted in FIG. 2A in which a region or regions of a color space associated with mapped pixel color values is identified and can be used to select a suitable color for interface frames, such as interface frames 114 depicted in FIG. 1.

Recall that color space 208, shown in FIG. 2A, represents a color space after one or more pixel color values has been mapped to it. Also recall that color space 208 is subdivided into eight smaller cubic regions, each encompassing a space that is defined by a smaller range of color values than color space 208. Now referring to FIG. 2B, color space 208 is depicted after one of its regions, (region 210) has been identified as a current region of interest. In this embodiment, region 210 is identified as a region of interest because it is associated with the most mapped pixel color values. While a single region of interest is depicted here, it is to be appreciated and understood that more than one region could be identified as a current region of interest without departing from the spirit and scope of the claimed subject matter For instance, several regions containing the most mapped pixel color values could all be identified as current regions of interest.

Next, note that current region of interest 210, which is defined by a smaller range of color values than color space 208, is effectively a new smaller color space—depicted here as color space 212. As such, color space 212 is also subdivided into a number of smaller regions; each defined by yet a smaller range of color values than that defining color space 208. Further, sample pixel color values can again been mapped into new color space 212 in the same manner as discussed above. Here, it should be noted that since color space 212 corresponds to a smaller range of colors than color space 208, some of the sample pixel color values may not fall within this new narrower range. In accordance with one embodiment, these non-mapping color values are simply disregarded. Once the sample pixel color values are again mapped as described above, a new current region of interest associated with the most recently mapped color values is identified—here depicted as region 214. Just as with current region of interest 210, current region of interest 214 is effectively a new, smaller color space—depicted here as color space 216.

This process of progressively narrowing the range of color values defining a current region of interest can be repeated any number of times until a final current region of interest is identified which is defined by color values corresponding to one or more single colors suitable for use. Here, in the interest of brevity, region 218 is shown as the final current region of interest. Region 218 is effectively a color space that is defined by color values corresponding to one or more single colors and is thus depicted as a darkened region In at least some embodiments, the final current region of interest is a color space defined by color values that correlate with a single color, for example R135, G206, B250 for a shade of light blue. By utilizing these principles and methods, this single color has been found to be the most prominent color comprising the sampled image—here image 112 (FIG. 1). As such, this color is assured of being aesthetically complimentary and suitable for use in the user interface frames associated with the image—here frames 114 (FIG. 1). In other embodiments however, a final current region of interest may be defined by a range of color values corresponding to more than one single color.

Figure 3:
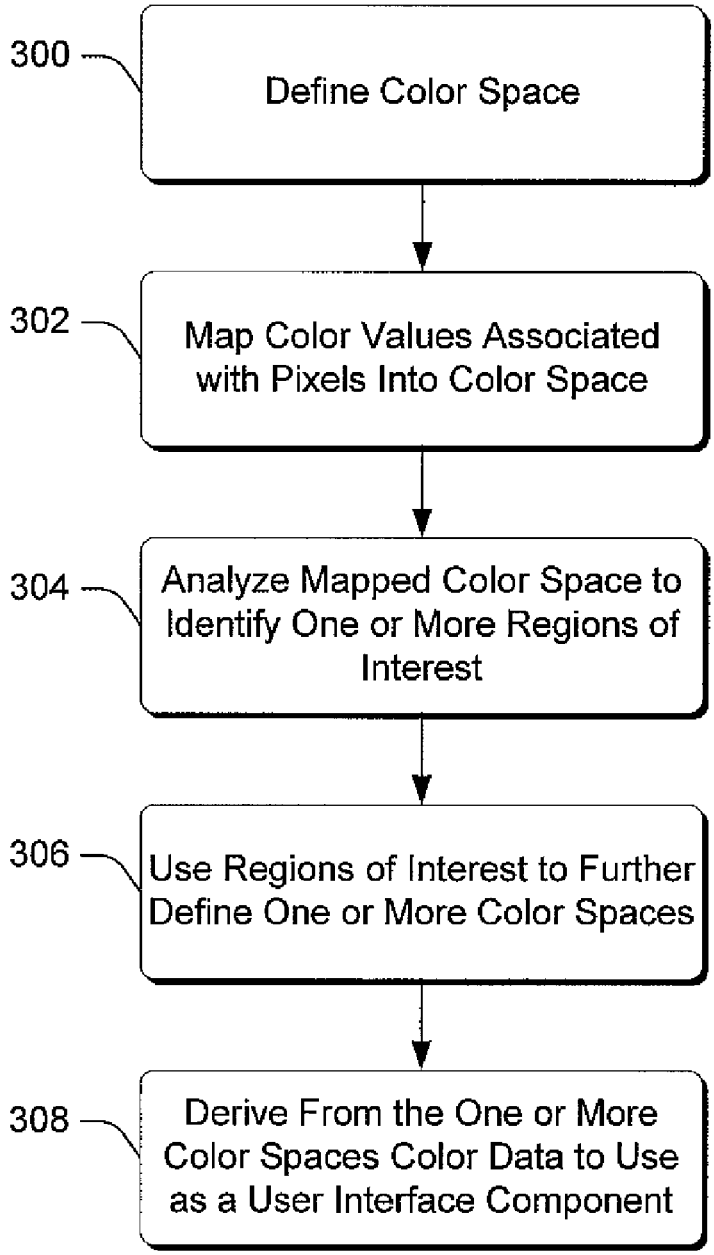
FIG. 3 is a flow diagram that describes steps in a method in accordance with one embodiment.

Now consider FIG. 3 which is a flow diagram that illustrates steps in a method in accordance with one embodiment. The method can be implemented in connection with any suitable hardware, software, firmware or combination thereof. In one embodiment, the method is implemented in software in the form of computer-executable instructions, such as those defining an application that executes on a client computing device, such as the client computing device depicted in FIG. 1.

Step 300 defines a color space. Any suitable color space can be utilized. In the example above, the color space is defined as a bounding geographical structure with its parameters or dimensions defined by a range of color values, such as "RGB" values for example. As discussed above, the color space can be subdivided into different regions, each defined by a smaller range of color values. After a color space is defined, step 302 maps the color values associated with pixels from an image into the color space. As noted, this mapping can be performed in any suitable way. In at least some embodiments, color values are mapped in a computationally efficient manner by associating each pixel's color value with a path or channel leading to one particular region of the color space.

Next, step 304 analyzes the mapped color space to identify one or more regions of interest in the color space. In at least some embodiments, like the one described above, the region(s) associated with the highest number of mapped pixel values is identified as the region(s) of interest. Step 306 uses these region(s) of interest to further define one or more new color spaces which can also be subdivided into different regions, each region being defined by a smaller range of color values than the one or more color spaces from which the region is derived. In accordance with at least some embodiments, the pixels can again be mapped into the one or more new color spaces such that a current region(s) of interest can be identified through analysis, effectively repeating steps 300, 302, 304 and 306. Hence, the process described by steps 300-306 can continue any number of times, on the fly, prior to step 308.

Finally, step 308 derives, from the one or more color spaces defined at step 306, color data that can be used as a component of a user interface. Recall that in at least some embodiments, like the one described above, a final current region of interest that is not to be further subdivided into smaller regions is used to define the one or more color spaces that correspond to this color data.

Exemplary Embodiment Utilizing a Three-dimensional Color Space

Figure 4:
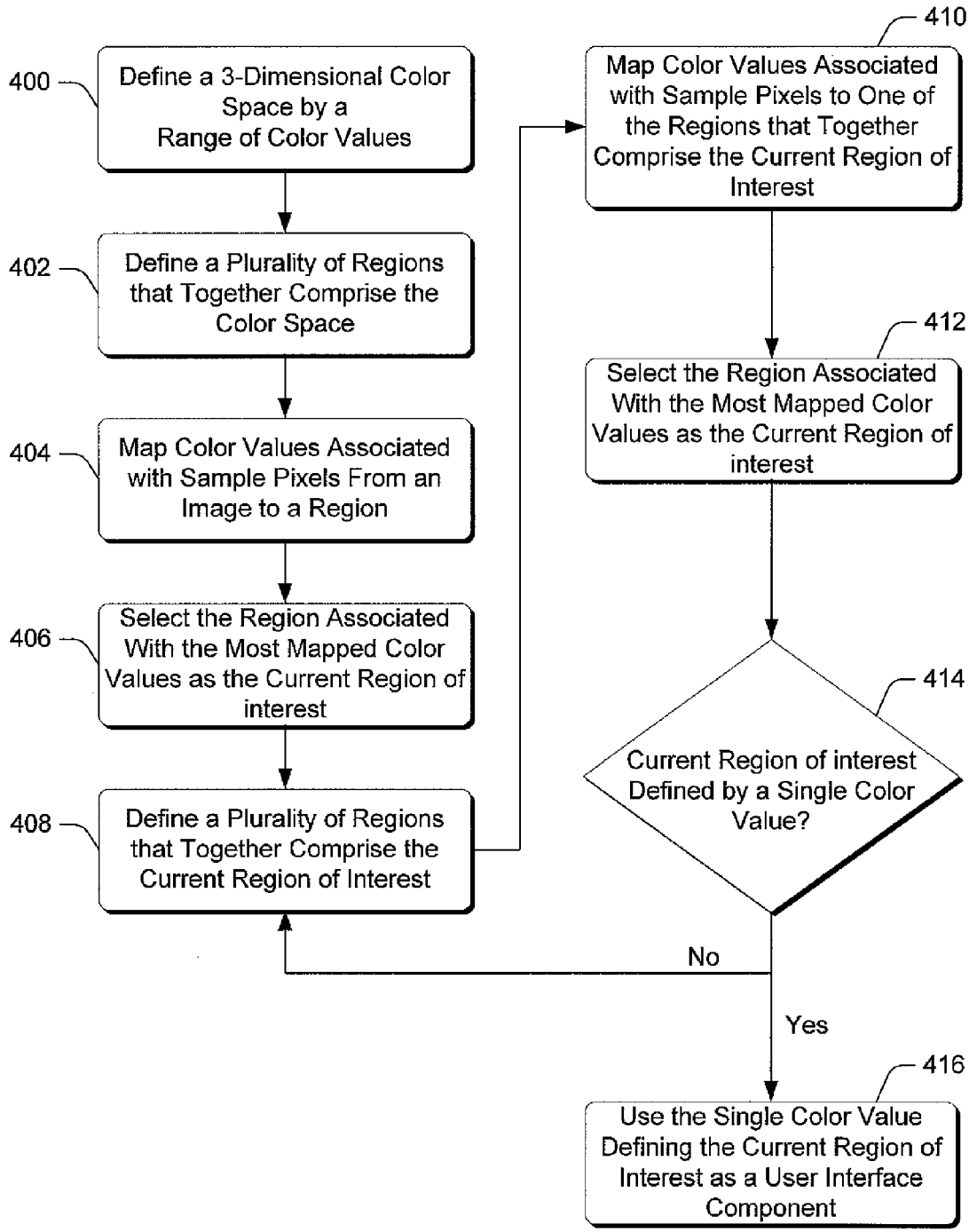
FIG. 4 is a flow diagram that describes steps in a method in accordance with an exemplary embodiment.

FIG. 4 is a flow diagram that illustrates steps in a method in accordance with an exemplary embodiment which utilizes a three-dimensional color space. It is to be appreciated and understood however that a color space can be any bounding geographical structure with any number of suitable dimensions. Also, this method can be implemented in connection with any suitable hardware, software, firmware or combination thereof. In one embodiment, the method is implemented in software in the form of computer-executable instructions, such as those defining an application that executes on a client computing device, such as the client computing device depicted in FIG. 1.

Step 400 defines a three dimensional color space by a range of color values. Note that a three dimensional color space, abstracted as a cube, is ideally suited to a color value type which utilizes three numerical values to define single colors, such as RGB. This is because the range of values for each single color can occupy, respectively, one axis of the color space.

Step 402 defines a plurality of regions that together comprise the total color space. Thus, the color space is subdivided into several distinct sub-regions, each defined by a smaller range of color values. In the embodiments described in this document, these regions are non-overlapping, each being defined by a smaller and distinct subset range of color values than are used to define the color space.

Next, step 404 maps color values associated with each of one or more sample pixels from an image to a respective region of the color space. As noted above, any suitable means of mapping can be used and the pixels can be associated with any suitable type of color value. For instance, using an indexing system which associates each pixel's color values with a particular channel leading to a respective region is one computationally efficient means of mapping. Further, recall that the sample of pixels may comprise all or part of an image. Utilizing a sample of pixels is important because, in at least some embodiments, computing efficiency and scalability can be maintained by utilizing only a portion of the total pixels from an image when the image exceeds an arbitrary designated size.

Once the color values have been mapped, step 406 selects the region associated with the most mapped color values as the current region of interest. Conceptually, the current region of interest can be characterized as a new color space defined by a smaller range of color values than that defining the color space defined in step 400. Furthermore, it should be noted that while in this exemplary embodiment a single region of interest is defined, alternative embodiments might define more than one current region of interest concurrently without departing from the spirit and scope of the clamed subject matter.

Moving on, step 408 defines a plurality of regions that together comprise the current region of interest. Thus, the current region of interest is subdivided into several distinct sub-divided regions, each defined by a smaller range of color values than that used to define the current region of interest. Step 410 next maps color values associated with each of the sample pixels to one of the respective sub-divided regions that comprise the current region of interest. As with step 404 above, any suitable means of mapping can be used.

Once these color values have been mapped, step 412 selects the sub-divided region associated with the most mapped color values as the current region of interest. This step is similar to step 406 except that here, a new current region of interest is defined that replaces the previous current region of interest. In other words, the current region of interest referenced in steps 408 and 410 is no longer the current region of interest and is replaced by the current region of interest defined in step 412.

Step 414 determines whether the current region of interest, defined in step 412, is defined by a single color value. Here, if it is not (i.e., the "no" branch), steps 408-412 are repeated. Hence, with this path, the current region of interest is not the final current region of interest. Note that steps 408-412 can be repeated any number of times, on the fly, until step 414 determines that the answer is "yes".

When this happens (i.e. the "yes" branch), step 416 uses the single color value (corresponding to a single color) as the user interface component.

Implementation Example

The following example encoded algorithm provides but one way that the principles and methods described above can be implemented. The code will be understood by the skilled artisan and constitutes but one exemplary implementation of the exemplary method described above. It is to be appreciated and understood that other means of implementing the described embodiments can be utilized without departing from the spirit and scope of the claimed subject matter.

```
// This algorithm basically forms a sampling grid over the image.
// It then runs through the image and sorts the colors based on
// octal partitions within the color space. We then use a binary
// search to narrow down the primary color of the image.
// Octal partition range parameters
BYTE bRedLower = 0;
BYTE bRedPartition = 127;
BYTE bRedUpper = 255;
BYTE bGreenLower = 0;
BYTE bGreenPartition = 127;
BYTE bGreenUpper = 255;
BYTE bBlueLower = 0;
BYTE bBluePartition = 127;
BYTE bBlueUpper = 255;
const int iRedIndex = 1;
const int iGreenIndex = 2;
const int iBlueIndex = 4;
// Image grid parameters (We pick 32 * 32 samples)
const DWORD dwGridSize = 32;
const DWORD dwWidth = pImage->GetWidth( );
const DWORD dwHeight = pImage->GetHeight( );
const DWORD dwWidthStep = dwWidth / dwGridSize ? dwWidth /
  dwGridSize : 1;
const DWORD dwHeightStep = dwHeight / dwGridSize ? dwHeight /
  dwGridSize : 1;
// We will only look through this 8 times
for (DWORD dw = 0; dw < 8; ++dw)
{
  // Start count empty
  DWORD dwCount[8] = {0};
  // Loop over image counting items in each octal partition
  for (DWORD y = 0; y < dwHeight; y += dwHeightStep)
  {
    for (DWORD x = 0; x < dwWidth; x += dwWidthStep)
    {
      // Get pixel (We could cache this to make this
        algorithm faster)
      COLORREF cr = pImage->GetPixel(x, y);
      // Get axis
      BYTE bRed = GetRValue(cr);
      BYTE bGreen = GetGValue(cr);
      BYTE bBlue = GetBValue(cr);
      // Find partition (Throw out if not in range)
      if (bRedLower <= bRed && bRed <= bRedUpper &&
        bGreenLower <= bGreen && bGreen <=
          bGreenUpper &&
        bBlueLower <= bBlue && bBlue <= bBlueUpper)
      {
        // Build index
        int iIndex = (bRed <= bRedPartition ? 0 :
              iRedIndex) +
            (bGreen <= bGreenPartition ? 0
              : iGreenIndex) +
            (bBlue <= bBluePartition ? 0 :
              iBlueIndex);
        dwCount[iIndex]++;
      }
    }
  }
  // Find octant zone with largest pixel count
  DWORD dwMax = 0;
  int iIndex = -1;
  for (DWORD i = 0; i < 8; ++i)
  {
    if (dwCount[i] > dwMax)
    {
      dwMax = dwCount[i];
      iIndex = i;
    }
  }
  // We now have our max octal, narrow search in on color
  bRedLower = (iIndex & iRedIndex) ? bRedPartition + 1 :
    bRedLower;
  bRedupper = (iIndex & iRedIndex) ? bRedUpper :
    bRedPartition;
  bRedPartition = bRedLower + ((bRedUpper - bRedLower) >> 1);
  bGreenLower = (iIndex & iGreenIndex) ? bGreenPartition + 1
    : bGreenLower;
  bGreenUpper = (iIndex & iGreenIndex) ? bGreenUpper :
    bGreenPartition;
```

-continued

```
  GreenPartition = bGreenLower + ((bGreenUpper - bGreenLower)
    >> 1);
  bBlueLower = (iIndex & iBlueIndex) ? bBluePartition + 1 :
    bBlueLower;
  bBlueUpper = (iIndex & iBlueIndex) ? bBlueUpper :
    bBluePartition;
  bBluePartition = bBlueLower + ((bBlueUpper - bBlueLower) >>
    1);
}
// Final color found...
crFinal = RGB(bRedPartition, bGreenPartition, bBluePartition);
```

Note first that the above algorithm defines a three dimensional color space using an RGB color value range, with the three dimensions defined by intensities of the colors red, green and blue. (e.g. "BYTE bRedLower=0; BYTE bRed Upper=255;"). Note also that this color space is subdivided into eight regions by partitioning the red, green and blue color value ranges (e.g. "BYTE RedPartition=127;"). Next, note that the algorithm assigns integer values to a red, blue and green index such that individual pixel color values can be subsequently mapped by the algorithm to one of eight of the eight regions. (e.g. "const int iRedIndex=1;"). Hence, there are eight different channels leading to the eight regions of the color space.

The algorithm next designates the pixel sample size. With this particular example algorithm, a grid size of 32 is designated ("const DWORD dwGridSize=32;"). This grid size is the number of samples across the image and down the image that are identified as sample pixels. As noted above, some or all of the pixels in the image can be identified as sample pixels. For instance, the algorithm here determines whether the image is smaller than the designated grid size ("DWORD dwWidthStep" and "DWORD dwHeightStep") and, if it is, designates every pixel in the image as a sample pixel.

Continuing on, the algorithm next scans over a two dimensional image, such as image 112 in FIG. 2A for example, in a grid like pattern, identifying sample pixels along this pattern ("COLORREF cr=pImage->GetPixel(x, y);") and their corresponding color values (e.g. "BYTE bRed=GetRValue (cr);). Note that pixels with color values that are not within the color value range of one of the regions are ignored("// Find partition (Throw out if not in range)"). Next, pixel color values that are within the color value range of one of the regions are effectively mapped to one of the eight regions and a count for each region is maintained ("// Build index"). This allows the region (octant zone) associated with the highest count of mapped pixel color values to be identified ("// Find octant zone with largest pixel count").

Finally, the region with the highest count of mapped pixel color values, which is effectively the current region of interest, is subdivided by the algorithm in the same manner as above ("// We now have our max octal, narrow search in on color").

The algorithm then loops back and begins mapping sample pixel color values, if within range, to one of the eight regions. Just as before, the region associated with the highest count is identified and subdivided into eight regions, thus perpetuating the cycle. ("for (DWORD dw=0; dw<8; ++dw) . . . "). In this particular algorithm, by virtue of the fact that the defined channels here are eight bits, a total of eight cycles is utilized ("for (DWORD dw=0; dw<8; ++dw)") before the color values defining the region associated with the highest count correspond to a single color ("crFinal=RGB (bRedPartition, bGreenPartition, bBluePartition);).

As a result of this algorithm, this single color will be the most prominent color in the image itself and will thus be suitable for use as a component of user interface frames adjacent or near the image, such as user interface frames 114 for example.

Conclusion

The various principles and methods described above provide an efficient and timely means by which a suitable color can be automatically selected for use in a frame that comprises part of a user interface.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

The invention claimed is:

1. A computer-implemented method comprising:

executing instructions by one or more processors in a computing device to perform acts comprising:

defining a color space that is to be used to provide color data for use with a component of a user interface, the color space defined at least by a range of color values for each of multiple colors;

mapping color values retrieved from pixels of a background image into the color space to produce a mapped color space;

progressively narrowing the range of color values for each of the multiple colors of the mapped color space by repeatedly analyzing at least a portion of the mapped color space to identify one or more regions of interest having a highest number of different mapped color values and subdividing the one or more regions of interest associated with a corresponding act of analyzing into one or more additional color spaces until a final region of interest is identified, the final region of interest being associated with at least one additional color space defined by color values corresponding to one or more prominent colors of the background image; and deriving, from the one or more prominent colors, color data to use as a component of a user interface that includes the background image.

2. The method of claim 1, wherein the color space corresponds to a range of RGB color values.

3. The method of claim 1, wherein each of said one or more additional color spaces is defined by a smaller range of color values than the range of color values defining the color space.

4. The method of claim 1, wherein said mapping comprises associating each of said color values to one of a plurality of channels, wherein each of the plurality of channels corresponds to one of a plurality of regions which together comprise said first-mentioned color space.

5. The method of claim 1, wherein said analyzing comprises determining which of said regions is associated with the highest number of different mapped color values.

6. The method of claim 1, wherein said one or more additional color spaces comprise individual abstracted cubes that geometrically subdivide corresponding of the one or more regions of interest.

7. The method of claim 1, wherein said subdividing the one or more regions of interest subdivides corresponding of the one or more regions of interest into four or more individual abstracted cubes, each individual abstracted cube associated with an additional color space which, together, comprise an associated subdivided color space.

8. A computer-implemented method comprising:

executing instructions by one or more processors in a computing device to perform acts comprising:

defining a multi-dimensional color space that is to be used to provide color data for use with a component of a user interface, the multi-dimensional color space having at least three dimensions, each dimension defined at least by a range of color values for a particular color;

defining a plurality of abstracted cube sub-regions of the multi-dimensional color space, each dimension of each abstracted cube sub-region defined at least by a smaller range of color values than that used to define the range of color values for each dimension of the multi-dimensional color space;

mapping color values retrieved from individual sample pixels of an image to a corresponding one of the plurality of sub-regions;

selecting a current region of interest associated with a most number of mapped color values, the current region of interest being selected from at least one of the plurality of abstracted cube sub-regions;

sub-dividing the current region of interest into a plurality of abstracted cube regions, each dimension of each of the abstracted cube regions defined at least by a smaller range of color values than that used to define the range of color values for each dimension of the current region of interest;

mapping color values associated with individual sample pixels to a corresponding one of the abstracted cube regions;

selecting a new current region of interest associated with a most number of mapped color values, the new current region of interest being selected from at least one of the abstracted cube regions;

repeating said sub-dividing, said second-mentioned mapping and said second-mentioned selecting until the new current region of interest is defined by a color value corresponding to a single color; and using said single color value as a component in a user interface that includes said image.

9. The method of claim 8, wherein the multi-dimensional color space corresponds to a range of RGB color values.

10. The method of claim 8 wherein said acts of mapping comprise:

associating each of said color values associated with said individual sample pixels with one of a plurality of channels; and wherein each of said channels is associated with an abstracted cube sub-region or abstracted cube region.

11. An instant messaging application embodied on a computer-readable media, the application being configured to implement the method of claim 8.

12. One or more computer-readable media having computer-readable instructions thereon which, when executed by a computer, implement the method of claim 8.

13. A system comprising:

a processor in communication with one or more computer-readable media;

computer-readable instructions on the one or more computer-readable media which, when executed, perform acts comprising:

presenting a user interface comprising a background image;

defining a color space, the color space comprising one or more dimensions, each dimension defined by a range of color values for a particular color;

mapping at least a subset of color values retrieved from pixels from the background image to the color space;

sub-dividing the color space into sub-regions;

selecting a sub-region of the color space having a most number of mapped color values;

repeatedly selecting and sub-dividing a sub-region of the color space having a greatest number of different mapped color values into sub-regions until a single color remains in at least one sub-region, the single color being a most prominent color in the background image; and using the single color value in a frame of the user interface.

14. The system of claim 13, wherein the color space comprises an RGB color space.

15. The system of claim 13, wherein the acts are performed by an instant messaging application.

16. The system of claim 13, wherein the mapping maps color values to a channel associated with a particular sub-divided portion of a color space.

17. The system of claim 16, wherein at least some individual color spaces are sub-divided into eight regions.

* * * * *